US011484182B2

(12) United States Patent
Brewer et al.

(10) Patent No.: US 11,484,182 B2
(45) Date of Patent: Nov. 1, 2022

(54) FRONT INDICATOR LIGHTING ASSEMBLY FOR AN APPLIANCE DOOR

(71) Applicant: Haier US Appliance Solutions, Inc., Wilmington, DE (US)

(72) Inventors: Kyle James Brewer, Louisville, KY (US); Jason Allen Rowe, Louisville, KY (US); Timothy David Kaiser, Louisville, KY (US); Michelle Diana Gross, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 64 days.

(21) Appl. No.: 17/063,784

(22) Filed: Oct. 6, 2020

(65) Prior Publication Data

US 2022/0104682 A1 Apr. 7, 2022

(51) Int. Cl.

| | |
|---|---|
| ***A47L 15/00*** | (2006.01) |
| ***A47L 15/42*** | (2006.01) |
| ***F21V 33/00*** | (2006.01) |
| *F21Y 115/10* | (2016.01) |

(52) U.S. Cl.

CPC ..... *A47L 15/4293* (2013.01); *A47L 15/4257* (2013.01); *A47L 15/4274* (2013.01); *F21V 33/0044* (2013.01); *F21Y 2115/10* (2016.08)

(58) Field of Classification Search

CPC ..... F21V 33/0044; A47L 15/4293; A47L 15/4257; A47L 15/4274

See application file for complete search history.

(56) References Cited

U.S. PATENT DOCUMENTS

| | | | | |
|---|---|---|---|---|
| 7,705,257 | B2 * | 4/2010 | Arione | H03K 17/962 200/600 |
| 8,922,979 | B2 | 12/2014 | Fluhrer | |
| 10,753,597 | B1 * | 8/2020 | Aguiar | F21V 33/0044 |
| 2008/0106429 | A1 * | 5/2008 | Kaczmarek | A47L 15/4257 340/679 |
| 2008/0273016 | A1 * | 11/2008 | Helgesen | A47L 15/4293 345/173 |
| 2008/0276976 | A1 * | 11/2008 | Buller | H03K 17/9627 345/173 |
| 2010/0319383 | A1 * | 12/2010 | Kim | F25D 23/08 62/449 |
| 2011/0271984 | A1 * | 11/2011 | Ireland | A47L 15/0021 134/18 |

(Continued)

FOREIGN PATENT DOCUMENTS

| | | | | |
|---|---|---|---|---|
| DE | 19724479 | A1 * | 12/1998 | A47L 15/4293 |
| DE | 10144668 | A1 * | 3/2003 | D06F 39/005 |

(Continued)

*Primary Examiner* — Gerald J Sufleta, II

(74) *Attorney, Agent, or Firm* — Dority & Manning, P.A.

(57) ABSTRACT

A door assembly for an appliance includes a door frame having a top edge and a user interface board positioned at the top edge of the door frame. A console cover is positioned over the user interface board and has a top surface defining a plurality of touch buttons and a front surface defining a front indicator extending at least partially along the vertical direction adjacent the top edge of the door frame. A side-fire light source is mounted on the user interface board for selectively emitting light energy toward the front indicator.

20 Claims, 5 Drawing Sheets

(56) References Cited

U.S. PATENT DOCUMENTS

| | | | | |
|---|---|---|---|---|
| 2011/0273375 | A1* | 11/2011 | Wilford | H03K 17/962 345/173 |
| 2015/0167955 | A1* | 6/2015 | Seeley | F21V 33/0044 312/328 |
| 2016/0051123 | A1* | 2/2016 | Gleixner | A47L 15/4257 134/113 |
| 2016/0373110 | A1* | 12/2016 | Koehne | F21V 23/04 |
| 2017/0188787 | A1* | 7/2017 | Min | H03K 17/9643 |
| 2017/0268766 | A1* | 9/2017 | Grohmann | F21V 15/04 |
| 2018/0135333 | A1* | 5/2018 | Viswanathan | F24C 15/02 |
| 2018/0160880 | A1* | 6/2018 | Dabade | A47L 15/4246 |
| 2019/0223685 | A1* | 7/2019 | Benton | A47B 96/20 |
| 2019/0226673 | A1* | 7/2019 | Benton | F21V 33/0044 |
| 2020/0054189 | A1* | 2/2020 | Ford, Jr. | A47L 15/4274 |
| 2020/0060509 | A1* | 2/2020 | Ponkshe | A47L 15/4293 |
| 2020/0129040 | A1 | 4/2020 | Brewer | |

FOREIGN PATENT DOCUMENTS

| | | | |
|---|---|---|---|
| DE | 102011075095 | A1 | 11/2012 |
| DE | 102017102888 | A1 | 9/2017 |

* cited by examiner

FRONT INDICATOR LIGHTING ASSEMBLY FOR AN APPLIANCE DOOR

FIELD OF THE INVENTION

The present subject matter relates generally to door assemblies for appliances, and more particularly to lighting assemblies and status indicators mounted within doors of appliances.

BACKGROUND OF THE INVENTION

Appliances frequently include doors for closing, insulating, concealing, or otherwise providing selective access to cavities or chambers of the appliance. These doors typically include an inner and outer door that are separated by an air gap which may be filled with fiberglass or insulating foam, e.g., for thermal insulation, sound dampening, etc. In order to provide a user with information regarding the appliance operation, e.g., such as a status of an operating cycle or an indication that a cycle is complete, status indicators are often positioned on the outer door of the appliance such that they are visible to a user of the appliance. In addition, or alternatively, appliances such as dishwasher appliance may include control panels that are integrated into the top of the dishwasher door, e.g., to minimize features on the outer door and provide a clean look.

Notably, however, the sleek appearance of top control dishwasher appliances can have drawbacks. For example, the control panel frequently displays an operational status while the dishwasher appliance is operating, and a user can have difficulty viewing the control panel on top control dishwasher appliances when the door is closed and the dishwasher is operating. Thus, it can be difficult for the user to determine the current operational status of top control dishwasher appliances while the door is closed and the control panel is hidden.

Accordingly, an appliance having an improved door and lighting assembly would be useful. More specifically, a door and lighting assembly for an appliance having simplified assembly and improved operational status indicators would be particularly beneficial.

BRIEF DESCRIPTION OF THE INVENTION

Aspects and advantages of the invention will be set forth in part in the following description, or may be obvious from the description, or may be learned through practice of the invention.

In one exemplary embodiment, a door assembly for an appliance is provided. The door assembly defines a vertical direction and includes a door frame having a top edge, a user interface board positioned at the top edge of the door frame, a console cover positioned over the user interface board, the console cover having a front surface defining a front indicator extending at least partially along the vertical direction adjacent the top edge of the door frame, and a side-fire light source mounted on the user interface board for selectively emitting light energy toward the front indicator.

In another exemplary embodiment, a dishwasher appliance defining a vertical direction, a lateral direction, and a transverse direction is provided. The dishwasher appliance includes a wash tub positioned within a cabinet and defining a wash chamber and a door assembly pivotally mounted to the cabinet to provide selective access to the wash chamber. The door assembly includes a door frame having a top edge, a user interface board positioned at the top edge of the door frame, a console cover positioned over the user interface board, the console cover having a front surface defining a front indicator extending at least partially along the vertical direction adjacent the top edge of the door frame, and a side-fire light source mounted on the user interface board for selectively emitting light energy toward the front indicator.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
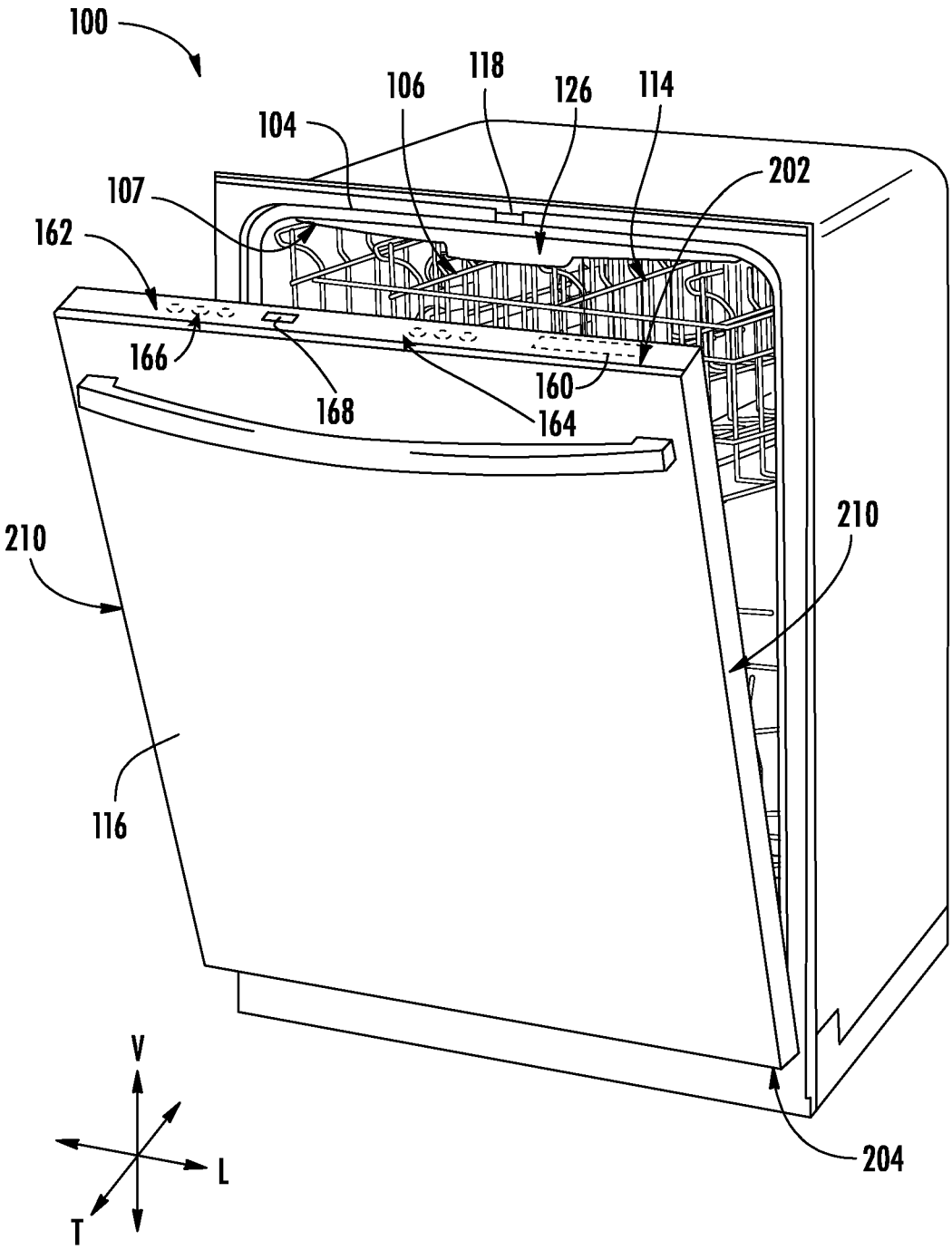
FIG. 1 provides a perspective view of a dishwasher appliance, including a dishwasher door according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. In addition, the term "or" is generally intended to be inclusive (i.e., "A or B" is intended to mean "A or B or both"). Furthermore, as used herein, terms of approximation, such as "approximately," "substantially," or "about," refer to being within a ten percent margin of error.

Figure 2:
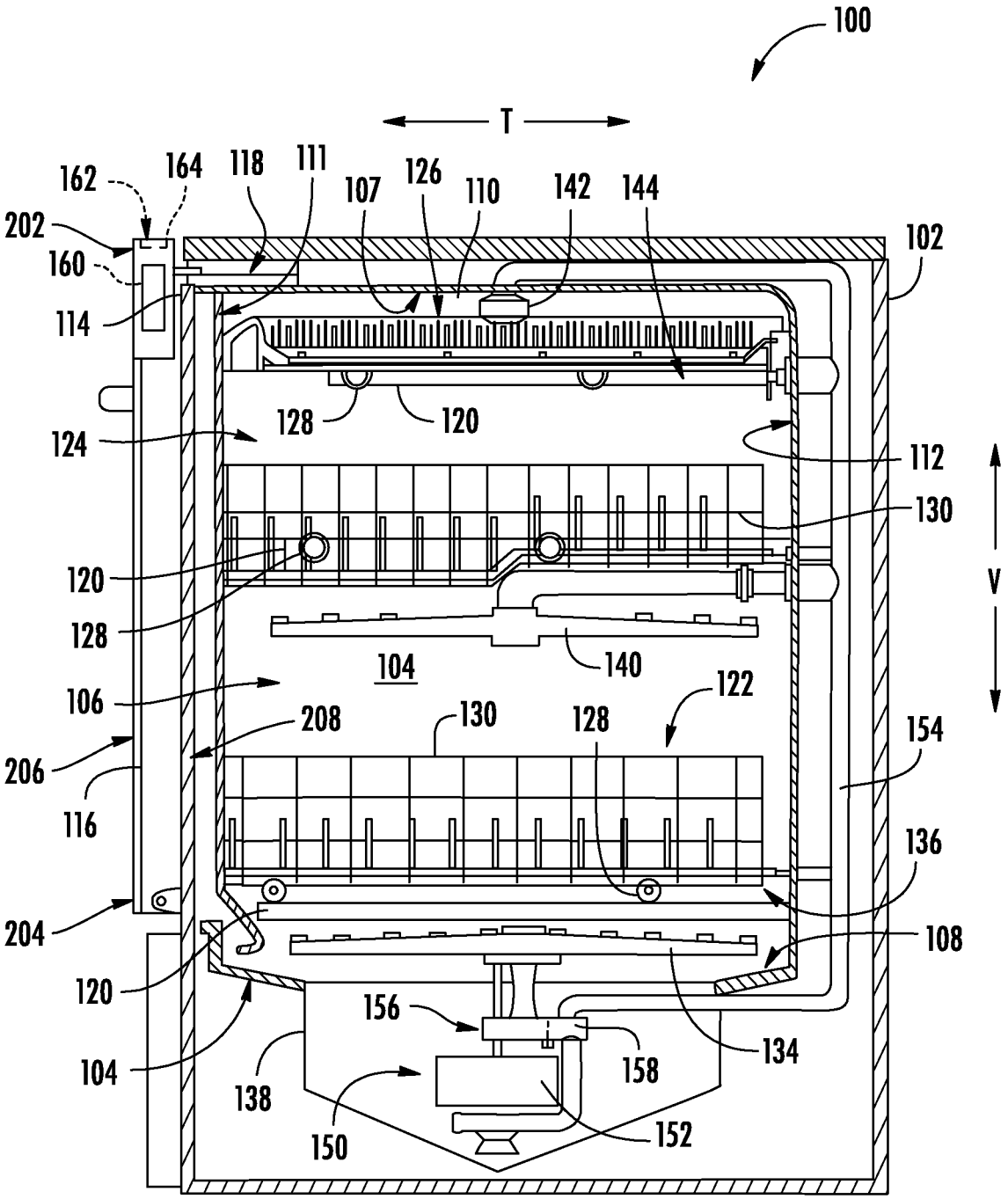
FIG. 2 provides a cross-sectional side view of the exemplary dishwashing appliance of FIG. 1.

FIGS. 1 and 2 depict an exemplary domestic dishwasher or dishwashing appliance 100 that may be configured in accordance with aspects of the present disclosure. For the particular embodiment of FIGS. 1 and 2, the dishwasher 100 includes a cabinet 102 having a tub 104 therein that defines a wash chamber 106. As shown, tub 104 extends between a top 107 and a bottom 108 along a vertical direction V, between a pair of side walls 110 along a lateral direction L, and between a front side 111 and a rear side 112 along a transverse direction T. Each of the vertical direction V, lateral direction L, and transverse direction T are mutually orthogonal to one another.

The tub 104 includes a front opening 114 and a door 116 hinged at its bottom for movement between a normally closed vertical position (shown in FIG. 2), wherein the wash chamber 106 is sealed shut for washing operation, and a horizontal open position for loading and unloading of articles from the dishwasher 100. According to exemplary embodiments, dishwasher 100 further includes a door closure mechanism or assembly 118 that is used to lock and unlock door 116 for accessing and sealing wash chamber 106.

As illustrated in FIG. 2, tub side walls 110 may accommodate a plurality of rack assemblies. More specifically, guide rails 120 may be mounted to side walls 110 for supporting a lower rack assembly 122, a middle rack assembly 124, and an upper rack assembly 126. As illustrated, upper rack assembly 126 is positioned at a top portion of wash chamber 106 above middle rack assembly 124, which is positioned above lower rack assembly 122 along the vertical direction V. Each rack assembly 122, 124, 126 is adapted for movement between an extended loading position (not shown) in which the rack is substantially positioned outside the wash chamber 106, and a retracted position (shown in FIGS. 1 and 2) in which the rack is located inside the wash chamber 106. This is facilitated, for example, by rollers 128 mounted onto rack assemblies 122, 124, 126, respectively. Although a guide rails 120 and rollers 128 are illustrated herein as facilitating movement of the respective rack assemblies 122, 124, 126, it should be appreciated that any suitable sliding mechanism or member may be used according to alternative embodiments.

Some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash fluid to reach and impinge on those articles (e.g., during a cleaning or rinsing cycle). According to another exemplary embodiment, a silverware basket (not shown) may be removably attached to a rack assembly (e.g., lower rack assembly 122) for placement of silverware, utensils, and the like, that are otherwise too small to be accommodated by rack 122.

Dishwasher 100 further includes a plurality of spray assemblies for urging a flow of water or wash fluid onto the articles placed within wash chamber 106. More specifically, as illustrated in FIG. 2, dishwasher 100 includes a lower spray arm assembly 134 disposed in a lower region 136 of wash chamber 106 and above a sump 138 so as to rotate in relatively close proximity to lower rack assembly 122. Similarly, a mid-level spray arm assembly 140 is located in an upper region of wash chamber 106 and may be located below and in close proximity to middle rack assembly 124. In this regard, mid-level spray arm assembly 140 may generally be configured for urging a flow of wash fluid up through middle rack assembly 124 and upper rack assembly 126. Additionally, an upper spray assembly 142 may be located above upper rack assembly 126 along the vertical direction V. In this manner, upper spray assembly 142 may be configured for urging or cascading a flow of wash fluid downward over rack assemblies 122, 124, and 126. As further illustrated in FIG. 2, upper rack assembly 126 may further define an integral spray manifold 144, which is generally configured for urging a flow of wash fluid substantially upward along the vertical direction V through upper rack assembly 126.

The various spray assemblies and manifolds described herein may be part of a fluid distribution system or fluid circulation assembly 150 for circulating water and wash fluid in the tub 104. More specifically, fluid circulation assembly 150 includes a pump 152 for circulating water or wash fluid (e.g., detergent, water, or rinse aid) in the tub 104. Pump 152 may be located within sump 138 or within a machinery compartment located below sump 138 of tub 104, as generally recognized in the art. Fluid circulation assembly 150 may include one or more fluid conduits or circulation piping for directing water or wash fluid from pump 152 to the various spray assemblies and manifolds. For example, as illustrated in FIG. 2, a primary supply conduit 154 may extend from pump 152, along rear 112 of tub 104 along the vertical direction V to supply wash fluid throughout wash chamber 106.

As illustrated, primary supply conduit 154 is used to supply wash fluid to one or more spray assemblies (e.g., to mid-level spray arm assembly 140 and upper spray assembly 142). However, it should be appreciated that according to alternative embodiments, any other suitable plumbing configuration may be used to supply wash fluid throughout the various spray manifolds and assemblies described herein. For example, according to another exemplary embodiment, primary supply conduit 154 could be used to provide wash fluid to mid-level spray arm assembly 140 and a dedicated secondary supply conduit (not shown) could be utilized to provide wash fluid to upper spray assembly 142. Other plumbing configurations may be used for providing wash fluid to the various spray devices and manifolds at any location within dishwasher appliance 100.

Each spray arm assembly 134, 140, 142, integral spray manifold 144, or other spray device may include an arrangement of discharge ports or orifices for directing wash fluid received from pump 152 onto dishes or other articles located in wash chamber 106. The arrangement of the discharge ports, also referred to as jets, apertures, or orifices, may provide a rotational force by virtue of wash fluid flowing through the discharge ports. Alternatively, spray arm assemblies 134, 140, 142 may be motor-driven, or may operate using any other suitable drive mechanism. Spray manifolds and assemblies may also be stationary. The resultant movement of the spray arm assemblies 134, 140, 142 and the spray from fixed manifolds provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only and are not limitations of the present subject matter.

In operation, pump 152 draws wash fluid in from sump 138 and pumps it to a diverter assembly 156 (e.g., which may be positioned within sump 138 of dishwasher appliance 100). Diverter assembly 156 may include a diverter disk (not shown) disposed within a diverter chamber 158 for selectively distributing the wash fluid to the spray arm assemblies 134, 140, 142 or other spray manifolds or devices. For example, the diverter disk may have a plurality of apertures that are configured to align with one or more outlet ports (not shown) at the top of diverter chamber 158. In this manner, the diverter disk may be selectively rotated to provide wash fluid to the desired spray device.

According to an exemplary embodiment, diverter assembly 156 is configured for selectively distributing the flow of wash fluid from pump 152 to various fluid supply conduits, only some of which are illustrated in FIG. 2 for clarity. More specifically, diverter assembly 156 may include four outlet ports (not shown) for supplying wash fluid to a first conduit for rotating lower spray arm assembly 134 in the clockwise direction, a second conduit for rotating lower spray arm assembly 134 in the counter-clockwise direction, a third conduit for spraying an auxiliary rack such as the silverware rack, and a fourth conduit for supply mid-level or upper spray assemblies 140, 142 (e.g., such as primary supply conduit 154).

The dishwasher 100 is further equipped with a controller 160 to regulate operation of the dishwasher 100. The controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 160 may be constructed without using a microprocessor (e.g., using a combination of discrete analog or digital logic circuitry, such as switches, amplifiers, integrators, comparators, flip-flops, AND gates, and the like) to perform control functionality instead of relying upon software.

The controller 160 may be positioned in a variety of locations throughout dishwasher 100. In the illustrated embodiment, the controller 160 may be located within a control panel area 162 of door 116, as shown in FIGS. 1 and 2. In such an embodiment, input/output ("I/O") signals may be routed between the control system and various operational components of dishwasher 100 along wiring harnesses that may be routed through the bottom of door 116. Typically, the controller 160 includes a user interface panel 164 through which a user may select various operational features and modes and monitor progress of the dishwasher 100. In one embodiment, the user interface 164 may represent a general purpose I/O ("GPIO") device or functional block. In certain embodiments, the user interface 164 includes input components 166, such as one or more of a variety of electrical, mechanical or electro-mechanical input devices including rotary dials, push buttons, and touch pads. The user interface 164 may further include one or more display components 168, such as a digital display device or one or more indicator light assemblies designed to provide operational feedback to a user. The user interface 164 may be in communication with the controller 160 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For example, different locations may be provided for user interface 164, different configurations may be provided for rack assemblies 122, 124, 126, different spray arm assemblies 134, 140, 142 and spray manifold configurations may be used, and other differences may be applied while remaining within the scope of the present subject matter. Moreover, aspects of the present subject matter may be applied to other appliances as well, such as refrigerators, ovens, microwaves, etc.

Figure 3:
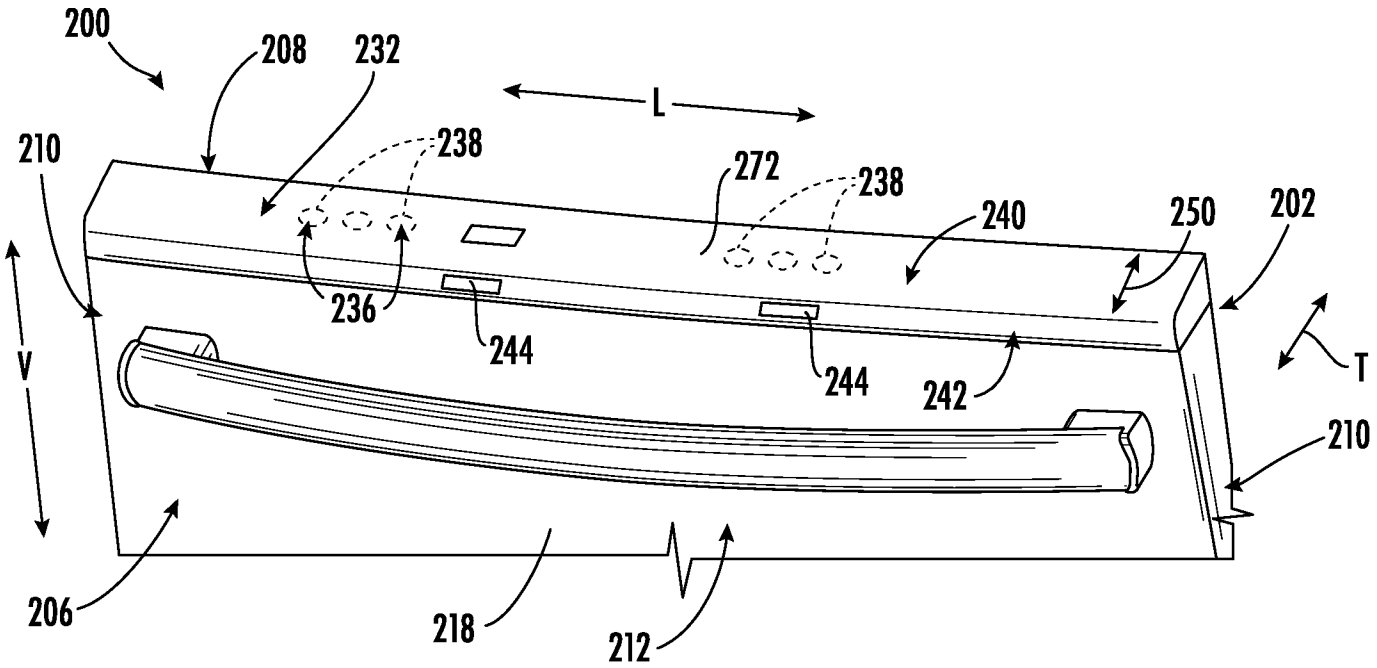
FIG. 3 provides a close-up perspective view of a control panel of the exemplary dishwasher door of FIG. 1 according to exemplary embodiments of the present disclosure.
Figure 4:
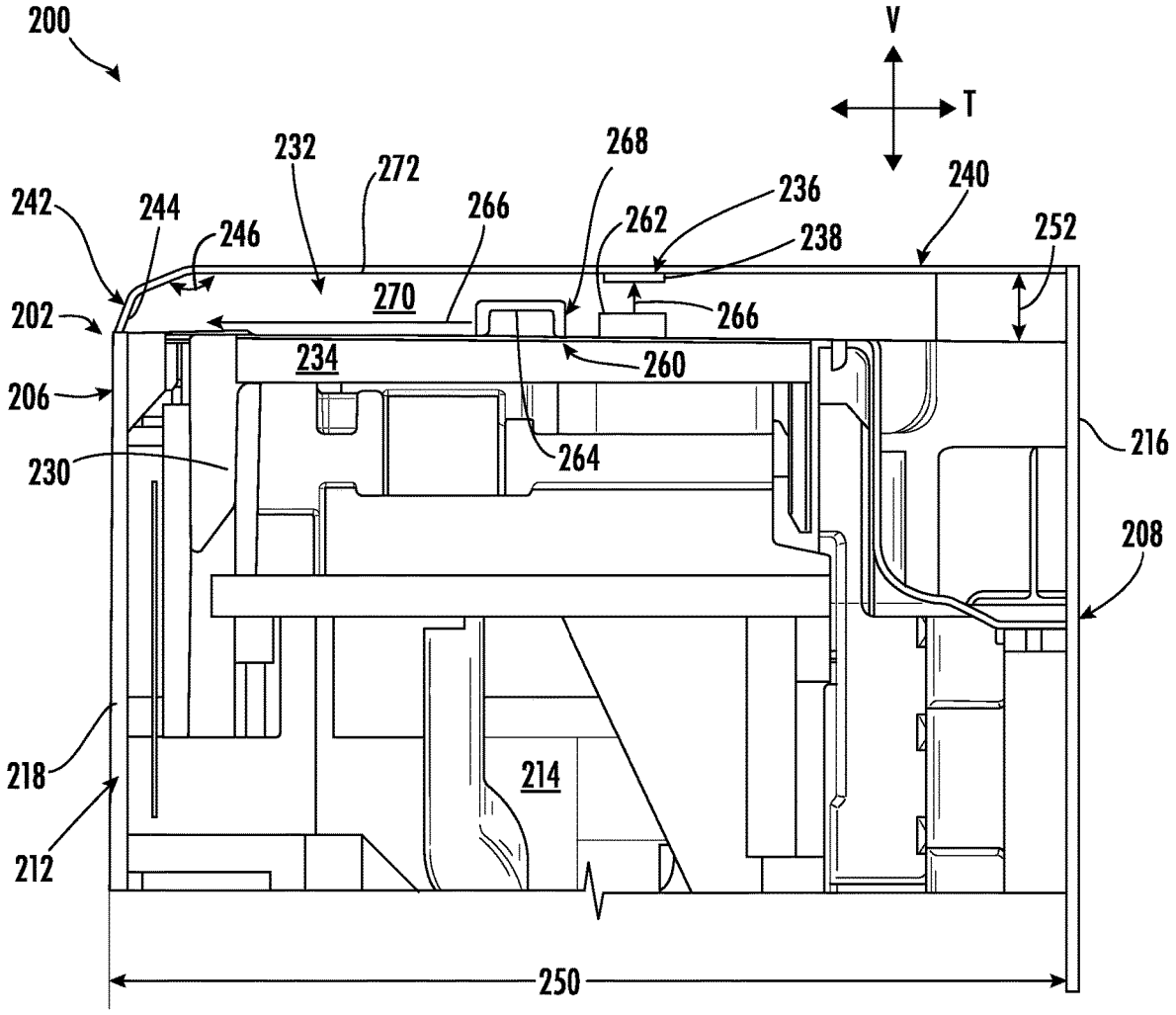
FIG. 4 provides a cross-sectional side view of the exemplary dishwasher door of FIG. 1 according to exemplary embodiments of the present disclosure.
Figure 5:
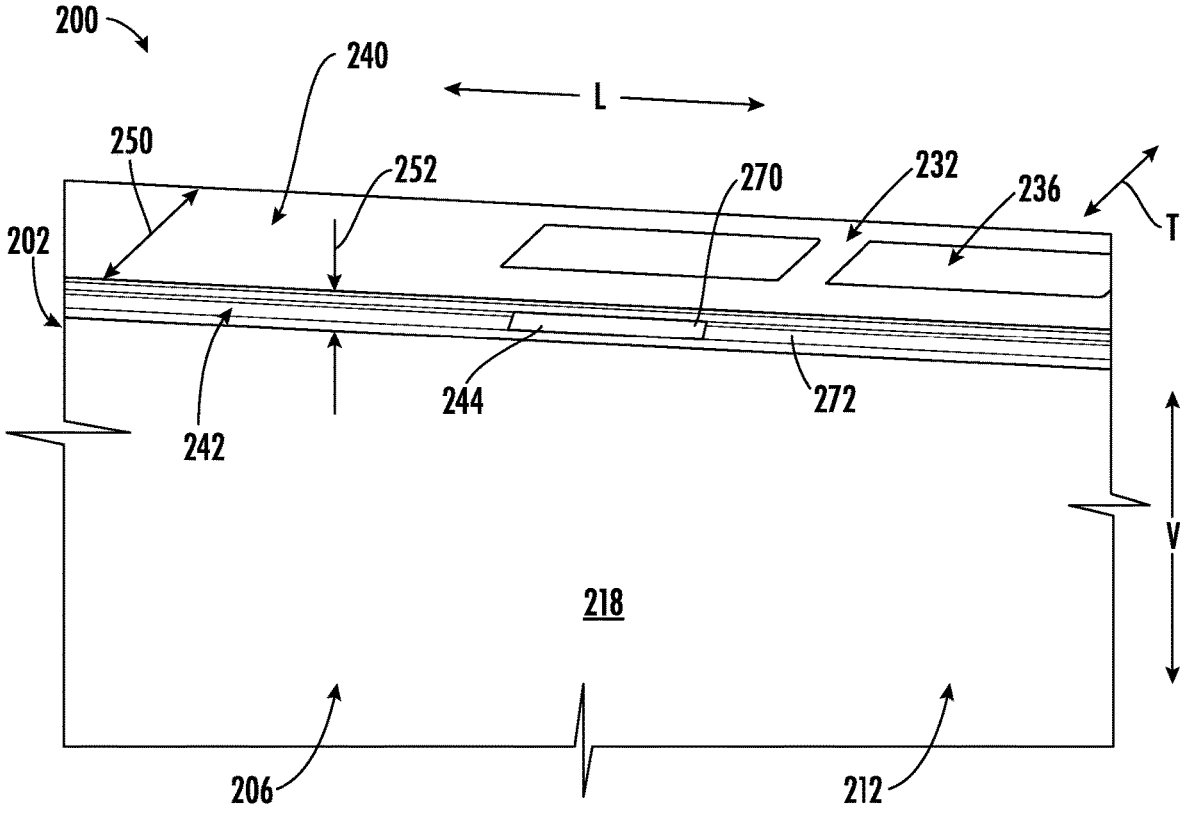
FIG. 5 provides a perspective view of the exemplary door assembly of FIG. 1 and the exemplary control panel of FIG. 3 according to an exemplary embodiment of the present subject matter.

Referring now generally to FIGS. 3 through 5, a door assembly 200 will be described according to exemplary embodiments of the present subject matter. For example, door assembly 200 may be used as door 116 of dishwashing appliance 100. Alternatively, door assembly 200 may be used on any other suitable residential or commercial appliance. As described herein, door assembly 200 may share a coordinate system with dishwashing appliance 100, e.g., when door assembly 200 is in the closed position (e.g., as shown in FIG. 2). Specifically, door assembly 200 may define a vertical direction V, a lateral direction L, and a transverse direction T. Therefore, these directions will also be used herein to refer to features of door assembly 200 and its various components and sub-assemblies. Referring briefly again to FIGS. 1 and 2, in the normally closed position, door assembly 200 (illustrated for example as door 116) extends from a top end or top edge 202 to a bottom end or bottom edge 204 along the vertical direction V; from a front end 206 to a rear end 208 along the transverse direction T; and between two lateral ends 210 along the lateral direction L.

As best illustrated in FIG. 4, door assembly 200 may include a door frame 212 that is formed from one or more exterior panels. In general, these exterior panels of door frame define an interior chamber 214 of door assembly 200. For example, door assembly 200 generally includes an inner door panel 216 and an outer door panel 218 which are spaced apart from each other along the transverse direction T to define a door gap or interior chamber 214 of door assembly 200 therebetween. For instance, outer door panel 218 may be positioned at or proximal to the front end 206 (i.e., distal to the rear end 208) and inner door panel 216 may be positioned at or proximal to the rear end 208 (i.e., distal to the front end 206).

According to exemplary embodiments, inner door panel 216 and outer door panel 218 may be panels that are stamped from stainless steel. Alternatively, inner door panel 216 and outer door panel 218 may be formed from any other suitably rigid material, such as thermoformed plastic, other metals, etc. In general, inner door panel 216 and outer door panel 218 may be assembled in any suitable manner. In addition, inner door panel 216 and outer door panel 218 may be secured together using any suitable mechanical fastener, welding, snap-fit mechanisms, etc. In addition, it should be appreciated that an insulating material (not shown), such as fiberglass or foam insulation, may be positioned within interior chamber 214 to provide thermal and/or sound insulation to dishwashing appliance 100.

Referring again to FIG. 4, door assembly 200 may further include a console bracket 230 which is positioned proximate top edge 202 of door assembly 200 along the vertical direction V. Specifically, console bracket 230 is positioned between and may be used to join inner door panel 214 and outer door panel 216. A console cover 232 may be positioned over or mounted on console bracket 230, inner door panel 214, and/or outer door panel 216. In this regard, console cover 232 is positioned on top of top edge 202 of door frame 212. Thus, e.g., console cover 232 may be partially hidden below a countertop when dishwasher appliance 100 is installed below the countertop and door 116 (e.g., door assembly 200) is closed. Accordingly, dishwasher appliance 100 may be referred to as a "top control dishwasher appliance." However, it should be appreciated that aspects of the present subject matter may be used with dishwasher appliances having other configurations or any other suitable appliance.

Console cover 232 is also positioned on door 106 such that a user can engage, e.g., touch, console cover 232. Thus, the user can activate/deactivate various cycles of dishwasher appliance 100 using console cover 232. In particular, dishwasher appliance 100 includes a user interface board 234, which may be a printed circuit board that is positioned within door frame 212, e.g., on top of console bracket 230. User interface board 234 may include or be operably coupled to one or more user inputs of touch buttons 236 (e.g., or user inputs 166) for receiving user input, providing user notifications, or illuminating to indicate cycle or operating status.

Specifically, according to the embodiment illustrated in FIG. 3, touch buttons 236 include a plurality of capacitive sensors 238 that are mounted to user interface board 234 and are operable to detect user inputs on console cover 232. For example, capacitive sensors 238 may be configured for triggering when a user touches a top surface 240 of console cover 232. In particular, capacitive sensors 238 can detect when a finger or another conductive material with a dielectric different than air contacts or approaches console cover 232. When a user touches top surface 240 of console cover 232 adjacent one of capacitive sensors 238, such capacitive sensor 238 triggers and, e.g., signals a controller (e.g., controller 160). In such a manner, operations of dishwasher appliance 100 can be initiated and controlled. Capacitive sensors 238 may be distributed laterally on user interface board 234 below console cover 232. It will be understood that other any suitable number, type, and position of capacitive sensors 238 may be used while remaining within the scope of the present subject matter. Indeed, any suitable number, type, and configuration of touch buttons 236 may be used while remaining within the scope of the present subject matter.

As best shown in FIGS. 3 through 5, console cover 232 may define a plurality of surfaces that are intended to be illuminated for various purposes. For example, touch buttons 236 or capacitive sensors 238 may be illuminated by light sources to inform the user of the location of the button or to provide some other status indication. Notably, this illumination is typically achieved by directing a light beam along the vertical direction V onto top surface 240 of console cover 232. In addition, console cover may have a front surface 242 that defines a front indicator 244. For example, according to the illustrated embodiment, front surface 242 and front indicator 244 both extend at least partially along the vertical direction V above and adjacent top edge 202 of door frame 212. In this regard, top surface 240 and front surface 242 are defined by a single console cover 232 to minimize components while providing improved user notification and interaction features, particularly when the door assembly 200 is in the closed position. In addition, the inclusion of the front surface 242 and front indicator 244 enables improved consumer interaction without requiring additional holes or indicators to be present on outer door panel 218. In this regard, front surface 242 of door assembly 200 may face towards a user of dishwasher appliance 100 when door assembly 200 is closed and may thus correspond to the outermost or visible panel of door assembly 200. Thus, a single piece of sheet metal may be used without any additional machining, thereby decreasing manufacturing time and costs while providing a cleaner more minimal appearance to front end 206 of door assembly 200.

As best shown in FIG. 4, front surface 242 extends in a non-parallel manner relative to top surface 240. Specifically, for example, front surface 242 and top surface 240 may be separated by an angle 246 (e.g. defined within a plane defined by the vertical direction V and the transverse direction T). The angle 246 between front surface 242 and top surface 240 may vary as needed depending on the application and illumination needs of door assembly 200. For example, angle 246 may be between about 90° and 180°, between about 95° and 150°, between about 98° and 120°, or about 100°. More specifically, according to the illustrated embodiment, front surface 242 may define an arcuate profile that slowly curves into and merges with top surface 240.

In addition, console cover 232 have any suitable size and shape to facilitate the desired illumination and user interaction features. For example, as shown in FIG. 4, console cover 232 may define a width 250 measured along the transverse direction T and a height 252 measured along the vertical direction V. As used herein, the term width ratio and the like is intended to refer to the width 250 of console cover 232 divided by the height 252 of console cover 232. It may generally be desirable that console cover 232 has a very high width ratio, e.g., to maintain a clean front end 206 of door assembly 200, to reduce the likelihood of light bleed along front surface 242, etc. According to exemplary embodiments, the width ratio may be greater than about 5, greater than about 10, greater than about 20, greater than about 30, greater than about 50, or greater. Other width ratios, dimensions, and geometry of console cover 232 are possible and within the scope of the present subject matter Door assembly 200 may further include a plurality of light sources or lighting devices that are configured for illuminating one or more surfaces of console cover 232. These lighting sources are identified herein generally by reference numeral 260. It should be appreciated that light sources 260 may include any suitable number, type, configuration, and orientation of light sources mounted at any suitable location to illuminate status indicators or buttons in any suitable colors, sizes, patterns, etc. In other words, light sources 260 may be provided as any suitable number, type, position, and configuration of electrical light source(s), using any suitable light technology and illuminating in any suitable color. For example, according to the illustrated embodiment, light sources 260 may include one or more light emitting diodes (LEDs), which may each illuminate in a single color (e.g., white LEDs), or which may each illuminate in multiple colors (e.g., multi-color or RGB LEDs) depending on the control signal from controller 160.

However, it should be appreciated that according to alternative embodiments, light sources 260 may include any other suitable traditional light bulbs or sources, such as halogen bulbs, fluorescent bulbs, incandescent bulbs, glow bars, a fiber light source, etc. Moreover, light sources 260 may be operably coupled (e.g., electrically coupled) to user interface board 234, another suitable control board, and/or controller 160 (FIG. 2). Activation or illumination of light source 260 may be generally controlled by a user interface board 234 or controller 160 (e.g., to indicate a user input, state of the dishwasher appliance, state of the wash cycle, or any other relevant information to a user).

Specifically, as best illustrated in FIG. 4, light sources 260 may include one or more vertically oriented light sources, referred to herein as vertical light sources 262. In this regard, vertical light sources 262 are generally positioned below and/or directed toward each of touch buttons 236 on top surface 240 of console cover 232. Thus, vertical light sources 262 generally direct a beam of light energy along the vertical direction V from a user interface board 234 toward top surface 240. Vertical light source 262 may thereby provide user indications, textual identifiers, button locators, or other illuminated features on top surface 240. Notably, however, vertical light sources 262 are not commonly visible when door assembly 200 is in the closed position, e.g., such that top surface 240 is positioned underneath the countertop. Therefore, aspects of the present subject matter are directed toward additional illumination features for illuminating front surface 242 of console cover 232.

Specifically, according to the illustrated embodiment, light sources 260 of door assembly 200 include one or more orthogonal light emitting devices, referred to herein as side-fire light sources 264. As shown, side fire light sources 264 may be mounted on user interface board 234 and are generally configured for directing a beam of light energy (e.g., referred to herein by reference numeral 266) substantially within a horizontal plane (e.g., as identified by the transverse direction T and/or the lateral direction L). Thus, according to the illustrated embodiment, side fire light sources 264 and front indicator 244 are located in a single horizontal plane. In addition, console cover 232 may define a pocket 268 sized for receiving side fire light sources 264 (or multiple pockets 268 for receiving vertical light sources 262). In this manner, side fire light sources 264 may be mounted on top of user interface board 234 while permitting a flush mount of console cover 232 at top edge 202 of door frame 212.

As best shown in FIG. 4, user interface board 234 may be positioned generally parallel to the horizontal plane (e.g., defined by the lateral direction L in the transverse direction T) or orthogonal to the vertical direction V within door assembly 200. As used herein, the term "generally" means within ten degrees of the stated angle when used in the context of board orientations. Arranging user interface board 234 in a generally parallel configuration can facilitate installation of user interface board 234 within door assembly 200. For example, such arrangement is advantageous from an assembly standpoint in that all fasteners and/or harness connectors may have a common orientation.

As shown, both vertical light sources 262 and side fire light sources 264 may be mounted to user interface board 234. In addition, vertical light sources 262 may be oriented for vertical illumination to illuminate touch buttons 236 while side fire light sources 264 are oriented to illuminate front indicator 244. In particular, side fire light sources 264 are operable to direct light beam 266 from within door assembly 200 towards and/or through front indicator 244 substantially along the transverse direction T. Although side fire light sources 264 are illustrated as illuminating front indicator 244, it should be appreciated that in alternative example embodiments, these lighting devices can be any suitable device for emitting light beam 266, e.g., such that light beam 266 is substantially perpendicular to a line that is normal to top edge 202 of door frame 212. For example, these light sources can be top-view LEDs or reverse-mount LEDs with light redirecting devices, such as reflectors, lenses, or fiber optic cables, that redirect light beam 266.

Generally, console cover 232 may be any suitable transparent or semitransparent feature for diffusing, directing, or otherwise transmitting light from a light source, as described in more detail below. For example, console cover 232 may be formed from a suitable transparent or translucent material configured to direct light energy, such as a dielectric material, such as glass or plastic, polycarbonate, polypropylene, polyacrylic, or any other suitable material.

According to exemplary embodiments the present subject matter, console cover 232 may be a dead fronted panel. As used herein, the term "dead front" and the like is generally intended to refer to portions of a control panel which may be used as indicators, buttons, interactive control surfaces, or other user-interaction features without exposing the user to the operating side of the equipment or live parts and connections, i.e., lights, electrical connections, etc. For example, console cover 232 may include a transparent or translucent body 270 and an opaque masking material 272 that is selectively printed on top surface 240 and front surface 242 of translucent body 270 to define touch buttons 236, front indicator 244, and/or other illuminated features on console cover 232. Thus, the dead fronted top surface 240 in front surface 242 may be the surfaces that are contacted for controlling dishwasher appliance 100 or which may be illuminated for purposes of indicating operating status or other conditions to the user of the dishwasher appliance 100, e.g., particularly when door assembly 200 is in the closed position. Notably, when light sources 260 associated with particular touch buttons 236 or front indicator 244 are deactivated, these features may match the color of opaque material 272 such that these illumination features of are not visible or difficult to differentiate from the rest of console cover 232.

Opaque material 272 may be deposited on translucent body 270 to define any suitable number, size, and configuration of illuminated features. These illuminated features may be shapes or include other forms such as symbols, words, etc. that are visible on console cover 232. More specifically, when vertical light sources 262 are energized, touch buttons 236 on top surface 240 may be illuminated. When side fire light sources 264 are energized, front indicator 244 on front surface 242 may be eliminated.

Although door assembly 200 is described herein as including a single side fire light source 264, it should be appreciated that door assembly 200 could include any suitable number, type, and position of side fire light sources 264. In this regard, console cover 232 and/or front indicator 244 may extend an entire width of door assembly 200 along the lateral direction L. Thus, front surface 242 may be visible along the entire width of door assembly 200 and may be used to indicate different operational statuses, the progress of cycles, etc. Therefore, front indicator 244 may include a plurality of different illumination regions, e.g., as defined by masking material or opaque material 272. Alternatively, the entire width of the front surface 242 may be void of opaque material 272 to define one elongated front indicator 244.

For example, according to one exemplary embodiment, a plurality of side fire light sources 264 may be spaced apart along the lateral direction L and may be selectively illuminated to form a cycle progress bar. In this regard, as the cycle commences side fire light sources 264 may be progressively illuminated starting at a first lateral end 210 of door assembly 200 (e.g., the left side) and moving toward a second lateral end 210 of door assembly 200 (e.g., the right side). It should be appreciated that the illumination patterns and light source configurations described herein are only exemplary and are not intended to limit the scope of the present subject matter in any manner.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A door assembly for an appliance, the door assembly defining a vertical direction and comprising:

a door frame having a top edge;

a user interface board positioned at the top edge of the door frame;

a console cover positioned over the user interface board, the console cover having a front surface and a top surface, wherein the front surface defines a front indicator extending at least partially along the vertical direction adjacent the top edge of the door frame and the top surface defines a top indicator;

a side-fire light source mounted on the user interface board for selectively emitting light energy toward the front indicator; and a vertical light source mounted on the user interface board for selectively emitting light energy toward the top indicator.

2. The door assembly of claim 1, wherein the top surface comprises a plurality of buttons, and wherein the plurality of buttons comprise capacitive sensors mounted to the user interface board, the capacitive sensors being operable to detect user inputs via contact with the console cover.

3. The door assembly of claim 2, further comprising:

additional light sources oriented along the vertical direction for illuminating the capacitive sensors.

4. The door assembly of claim 1, wherein the console cover comprises:

a translucent body; and an opaque material deposited on the translucent body to define a plurality of touch buttons and the front indicator.

5. The door assembly of claim 1, wherein the front indicator is dead fronted when the side-fire light source is deactivated.

6. The door assembly of claim 1, wherein the front indicator includes textual material.

7. The door assembly of claim 1, wherein the side-fire light source and the front indicator are in a single horizontal plane.

8. The door assembly of claim 1, wherein the console cover defines a pocket for receiving the side-fire light source.

9. The door assembly of claim 1, wherein the front surface of the console cover extends above the top edge of the door frame at least partially along the vertical direction.

10. The door assembly of claim 1, wherein the top surface and the front surface of the console cover are separated by an angle between 90 degrees and 110 degrees.

11. The door assembly of claim 1, wherein the front surface of the console cover is arcuate.

12. The door assembly of claim 1, wherein the console cover defines a height and a width, and wherein a width ratio of the width over the height is greater than 20.

13. The door assembly of claim 1, wherein the door assembly comprises:

a plurality of side-fire light sources mounted to the control board, the plurality of side-fire light sources being oriented to illuminate a plurality of front indicators defined on the console cover.

14. The door assembly of claim 13, wherein each of the plurality of side-fire light sources are spaced apart along a lateral direction and are selectively illuminated to form a cycle progress bar.

15. The door assembly of claim 1, wherein the side-fire light source is a multi-color light emitting diode (LEDs).

16. The door assembly of claim 1, wherein the door frame comprises:

an outer door panel defining the top edge;

an inner door panel spaced apart from the outer door panel to define an interior chamber; and a console bracket extending between the inner door panel and the outer door panel along a transverse direction, wherein the user interface board is mounted to the console bracket and the console cover is mounted over top of the user interface board.

17. A dishwasher appliance defining a vertical direction, a lateral direction, and a transverse direction, the dishwasher appliance comprising:

a wash tub positioned within a cabinet and defining a wash chamber; and a door assembly pivotally mounted to the cabinet to provide selective access to the wash chamber, the door assembly comprising:

a door frame having a top edge;

a user interface board positioned at the top edge of the door frame;

a console cover positioned over the user interface board, the console cover having a front surface and a top surface, wherein the front surface defines a front indicator extending at least partially along the vertical direction adjacent the top edge of the door frame and the top surface defines a top indicator;

a side-fire light source mounted on the user interface board for selectively emitting light energy toward the front indicator; and a vertical light source mounted on the user interface board for selectively emitting light energy toward the top indicator.

18. The dishwasher appliance of claim 17, wherein the console cover comprises:

a translucent body; and an opaque material deposited on the translucent body to define a plurality of touch buttons and the front indicator.

19. The dishwasher appliance of claim 17, wherein the door assembly comprises:

a plurality of side-fire light sources mounted to the control board, the plurality of side-fire light sources being oriented to illuminate a plurality of front indicators defined on the console cover, wherein each of the plurality of side-fire light sources are spaced apart along a lateral direction and are selectively illuminated to form a cycle progress bar.

20. A door assembly for an appliance, the door assembly defining a vertical direction and comprising:

a door frame having a top edge and comprising an outer door panel defining the top edge, an inner door panel spaced apart from the outer door panel to define an interior chamber, and a console bracket extending between the inner door panel and the outer door panel along a transverse direction;

a user interface board positioned at the top edge of the door frame, wherein the user interface board is mounted to the console bracket;

a console cover positioned over the user interface board, the console cover having a front surface defining a front indicator extending at least partially along the vertical direction adjacent the top edge of the door frame; and a side-fire light source mounted on the user interface board for selectively emitting light energy toward the front indicator.

* * * * *